United States Patent [19]

Almond, II

[11] Patent Number: 5,013,171

[45] Date of Patent: May 7, 1991

[54] BODY LOTION APPLICATOR APPARATUS

[76] Inventor: Arthur W. Almond, II, 11808 Chase Wellesley Dr. #1321, Richmond, Va. 23233

[21] Appl. No.: 493,781

[22] Filed: Mar. 15, 1990

[51] Int. Cl.[5] ..... A46B 5/02

[52] U.S. Cl. ..... 401/6; 401/8; 401/99; 15/222

[58] Field of Search ..... 401/6–8, 401/99, 109; 239/48; 15/222, 230.13

[56] References Cited

U.S. PATENT DOCUMENTS

| | | | |
|---|---|---|---|
| 910,419 | 1/1909 | Schell | 15/222 |
| 1,201,897 | 10/1916 | Wallace | 239/48 |
| 1,271,769 | 7/1918 | Raymond | 239/48 |
| 1,368,078 | 2/1921 | Vanderbitt | 15/222 X |
| 1,369,404 | 2/1921 | Denton | 15/222 |
| 1,777,820 | 10/1930 | Anenberg | 239/48 |
| 1,944,395 | 1/1934 | Bell | 15/222 X |
| 4,196,490 | 4/1980 | Jonzon | 401/8 X |
| 4,906,118 | 3/1990 | Crooks | 401/6 |

FOREIGN PATENT DOCUMENTS

| | | | |
|---|---|---|---|
| 611266 | 10/1948 | United Kingdom | 15/222 |

*Primary Examiner*—Danton D. DeMille
*Attorney, Agent, or Firm*—Leon Gilden

[57] ABSTRACT

Apparatus including a cylindrical housing retractably containing an elongate continuous web retractable therefrom. The web is mounted in a surrounding relationship to a support cylinder that is biased into a retracted position to a central port spindle. The web is retracted through a elongate flexible lip cooperative with an absorbent sponge like roller to contain and confine lotion onto the associated web. A friction cylinder maintains engagement to enhance retraction and extension of the web in cooperation with the support cylinder and exit opening defined within the cylinder.

6 Claims, 6 Drawing Sheets

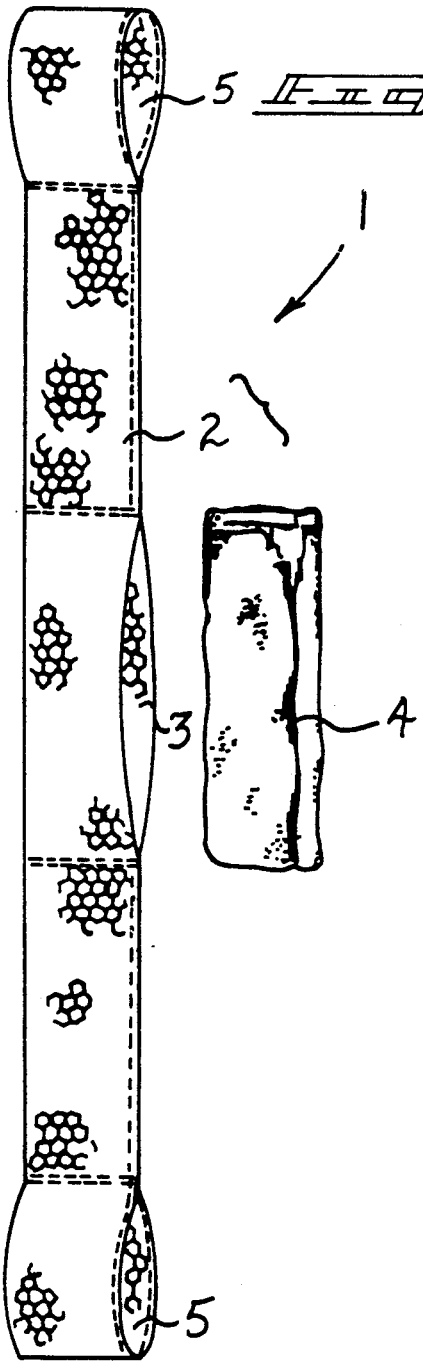
Fig 1
PRIOR ART
Fig 2
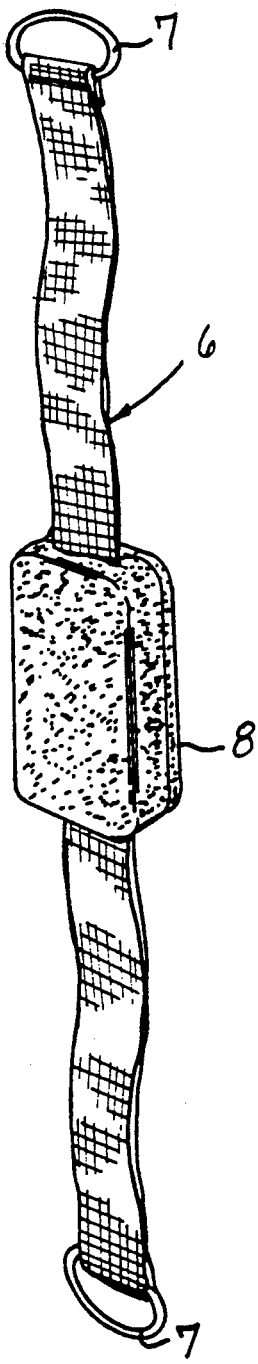
PRIOR ART

BODY LOTION APPLICATOR APPARATUS

BACKGROUND OF THE INVENTION

1. Field of the Invention

The field of the invention relates to lotion applicator apparatus, and more particularly pertains to a new and improved body lotion applicator apparatus wherein the same includes a self-contained housing permitting extension or retraction for an elongate lotion applicator web therefrom.

2. Description of the Prior Art

This applicator is frequently utilized to apply lotion to portions of the human anatomy difficult to outwardly cope with a fluid. Such portions include the back surface of the human anatomy and to this extent, brushes and elongate webs are frequently utilized. The use of webs, their storage prior to and subsequent to their use presents a degree of difficulty to maintain the lotion in a clean and non-contaminated state. Examples of the prior art include U.S. Pat. No. 3,959,841 to Horne setting forth an elongate web with a pocket positioned medially therewithin to receive a sponge for storage and application of a fluid through the sponge and applied by a application of the web about an anatomical portion of individual.

U.S. Pat. No. 4,196,490 to Jonzon sets forth a sponge mounted medially of an elongate flexible web wherein the web includes a handle mounted on each end thereof and the sponge is provided with an absorbent nature to direct an application of fluid onto an individual.

U.S. Pat. No. 3,674,374 to Jennings sets forth an elongate back scrubber apparatus formed with a plurality of pockets for application of a soap onto an individual.

U.S. Pat. No. 2,764,771 to Marchese provides a sponge mounted to a flange member and the flange includes a loop structure mounted at each end pivotally to the flange with a bulb applicator arranged to direct a quantity of soap into the sponge member.

U.S. Pat. No. 3,870,419 to SAGE sets forth a resilient body including a chamber therewithin to receive a quantity of soap therewithin with straps mounted to each end of the body to permit directing of soap from within the chamber to an individual's body portion wherein the chamber is directed through to the body by various openings formed therethrough.

As such, it may be appreciated that there continues to be a need for a new and improved body lotion applicator apparatus wherein the same addresses both the problems of ease of use as well as effectiveness in construction and in this respect, the present invention substantially fulfills this need.

SUMMARY OF THE INVENTION

In view of the foregoing disadvantages inherent in the known types of lotion applicator apparatus present in the prior art, the present invention provides a new and improved body lotion applicator apparatus wherein the same permits ease of extension and application of lotion from an associated reservoir onto an individual and subsequently permits retraction of an associated applicator web within the reservoir for storage during periods of non-use. As such, the general purpose of the present invention, which will be described subsequently in greater detail, is to provide a new and improved body lotion applicator apparatus which has all the advantages of the prior art lotion applicator apparatus and none of the disadvantages.

To attain this, the body lotion applicator apparatus of the invention includes apparatus including a cylindrical housing retractably containing an elongate continuous web retractable therefrom. The web is mounted in a surrounding relationship to a support cylinder that is biased into a retracted position to a central port spindle. The web is retracted through a elongate flexible lip cooperative with an absorbent sponge like roller to contain and confine lotion onto the associated web. A friction cylinder maintains engagement to enhance retraction and extension of the web in cooperation with the support cylinder and exit opening defined within the cylinder.

There has thus been outlined, rather broadly, the more important features of the invention in order that the detailed description thereof that follows may be better understood, and in order that the present contribution to the art may be better appreciated.

There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved body lotion applicator apparatus which has all the advantages of the prior art body lotion applicator apparatuses and none of the disadvantages.

It is another object of the present invention to provide a new and improved body lotion applicator apparatus which may be easily and efficiently manufactured and marketed.

It is a further object of the present invention to provide a new and improved body lotion applicator apparatus which is of a durable and reliable construction.

An even further object of the present invention is to provide a new and improved body lotion applicator apparatus which is susceptible of a low cost of manufacture with regard to both materials and labor, and which accordingly is then susceptible of low prices of sale to the consuming public, thereby making such body lotion applicator apparatuses economically available to the buying public.

Still yet another object of the present invention is to provide a new and improved body lotion applicator apparatus which provides in the apparatuses and methods of the prior art some of the advantages thereof, while simultaneously overcoming some of the disadvantages normally associated therewith.

Still another object of the present invention is to provide a new and improved body lotion applicator apparatus which may be compactly stored when not being utilized.

Yet another object of the present invention is to provide a new and improved body lotion applicator apparatus wherein the same is portability of a self-contained reservoir and associated web normally retracted within the reservoir to permit selective extension of the web relative to the reservoir for application of lotion from the reservoir onto an individual's body surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art lotion applicator apparatus.

FIG. 2 is an isometric illustration of a further prior art lotion applicator apparatus.

DESCRIPTION OF THE PREFERRED EMBODIMENT

Figure 3:
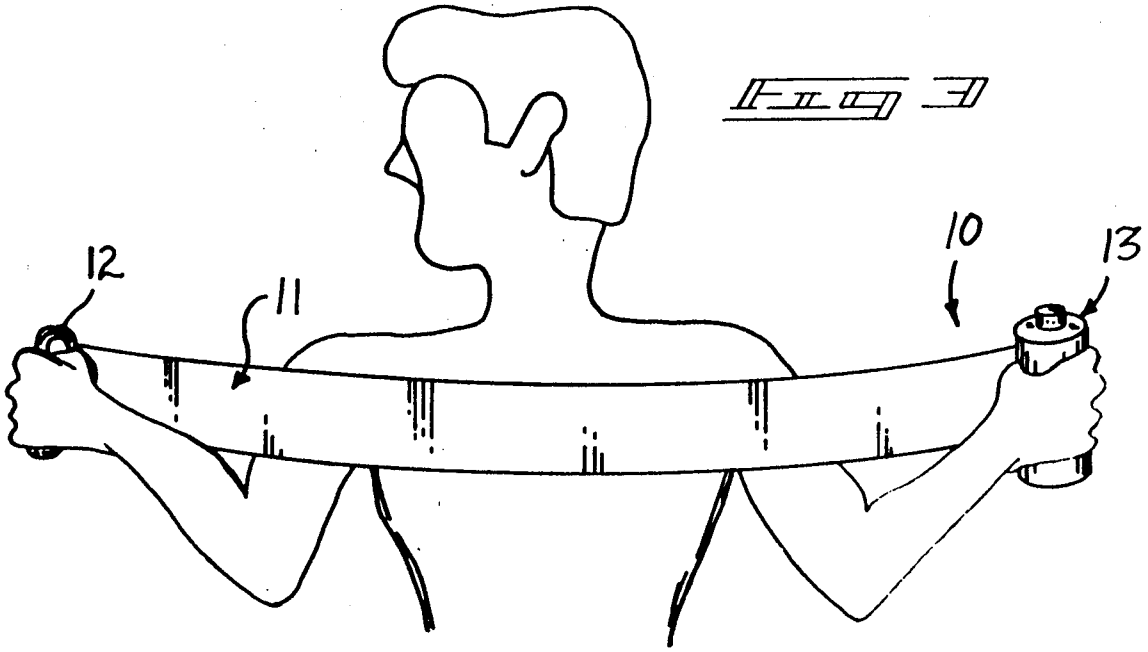
FIG. 3 is an isometric illustration of the applicator apparatus of the instant invention in use.
Figure 4:
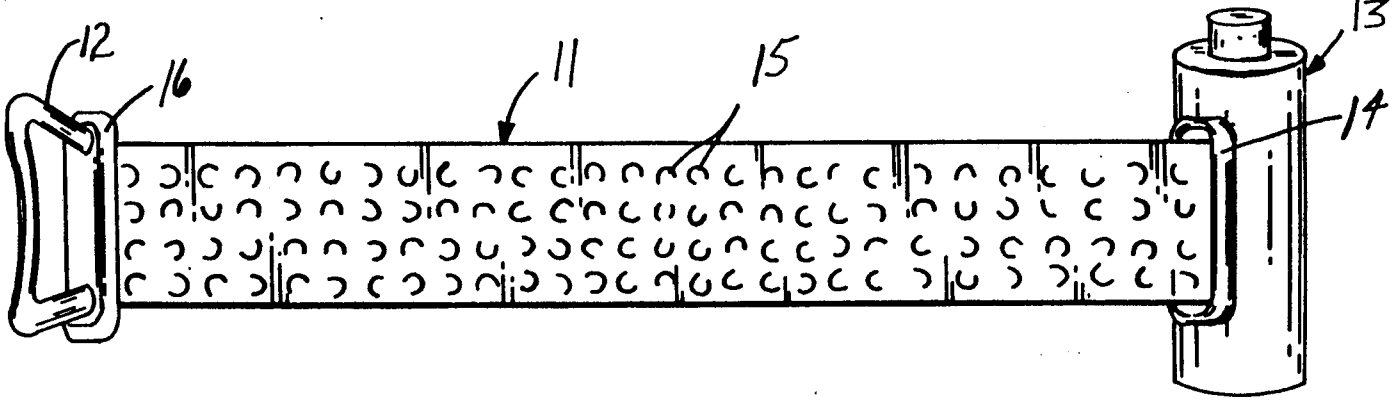
FIG. 4 is an isometric illustration of the applicator with the web extended relative to the associated reservoir housing.
Figure 5:
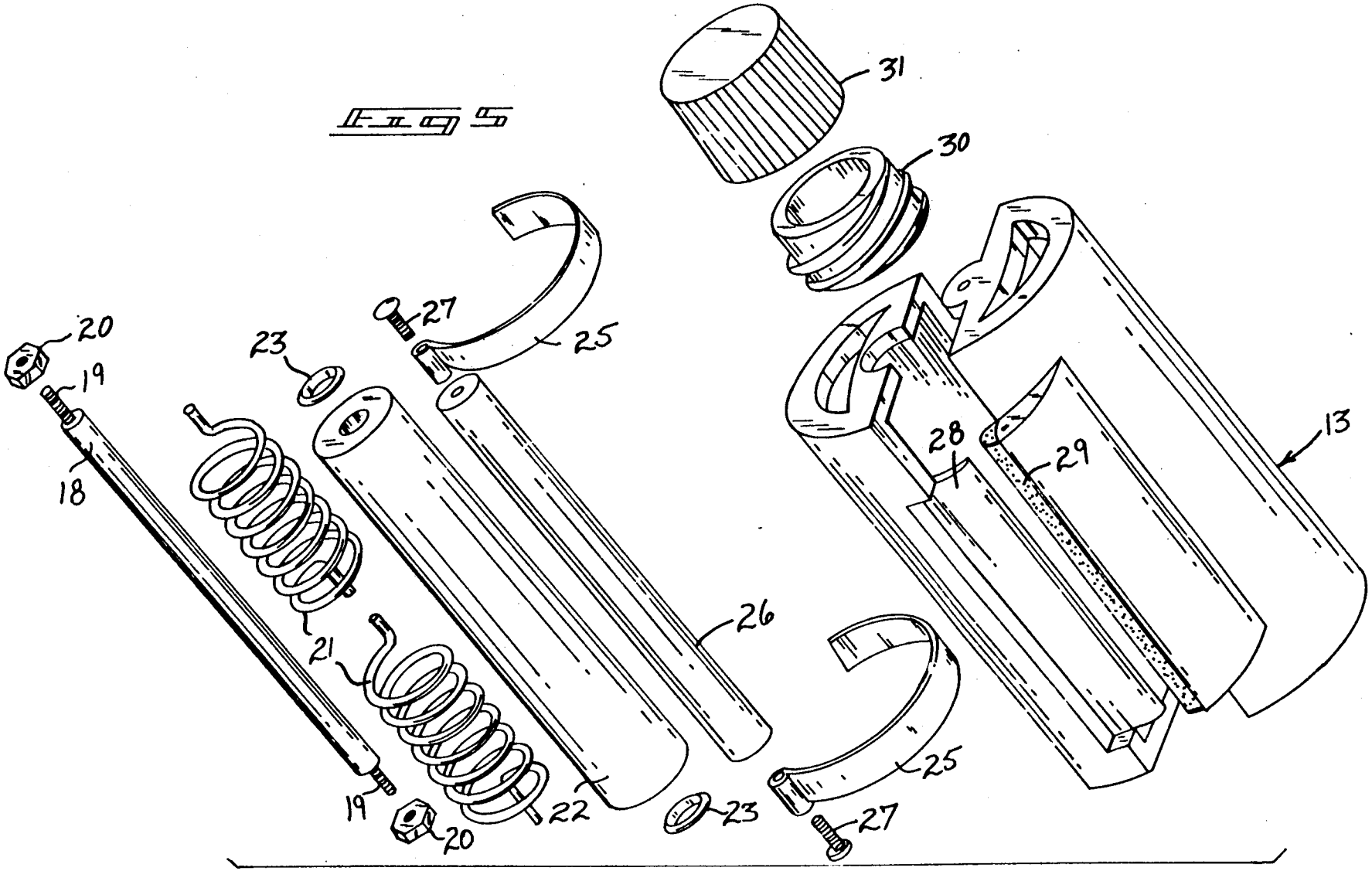
FIG. 5 is an exploded isometric illustration of the reservoir housing utilized by the instant invention.

With reference now to the drawings, and in particular to FIGS. 1 to 13 thereof, a new and improved body lotion applicator apparatus embodying the principles and concepts of the present invention and generally designated by the reference numeral 10 will be described.

FIG. 1 illustrates a prior art lotion applicator 1 including an elongate flexible belt with a pocket 3 mounted medially thereof for receiving a sponge member 4 within the pocket wherein the sponge typically contains a quantity of lotion therewithin for directing of the fluid lotion onto an individual utilizing the spaced handles 5 mounted at each end of the belt.

FIG. 2 illustrates a further prior art applicator member 6 wherein a sponge member 8 is mounted medially and integrally to a web belt member that includes fixed handles 7 at each end thereof.

Figure 6:
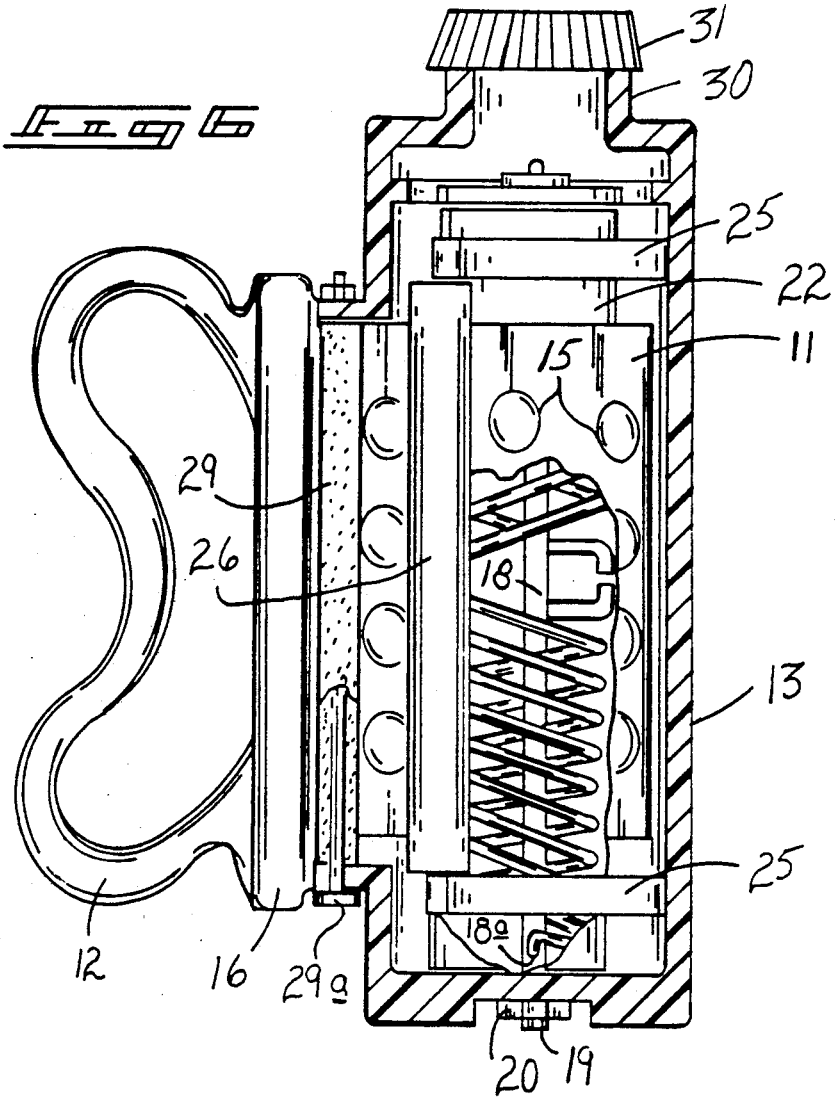
FIG. 6 is an isometric view partially in section of the instant invention in a retracted configuration.
Figure 11:
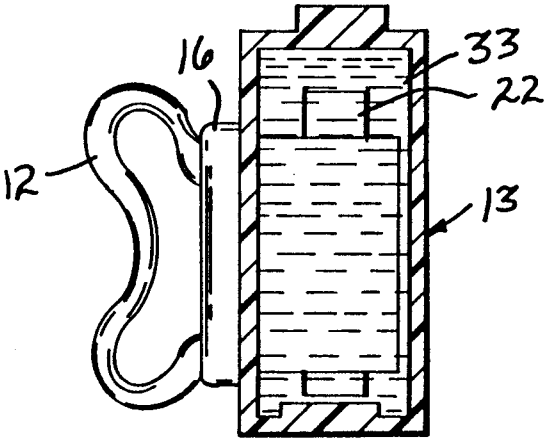
FIG. 11 is an orthographic cross-sectional view illustrating the reservoir and web in a retracted configuration.

More specifically, the body lotion applicator apparatus 10 essentially comprises an elongate flexible longitudinally aligned web 11 including a rigid handle 12 mounted at a free terminal end of the web. A cylindrical housing 13 retractively receives the belt therewithin and integrally secures the remaining end of the web 11 therewithin to bias the web within the housing 13 and in a normally retracted first position. The web is received within the housing 13 within a continuous flange 14 directed upwardly and diametrically aligned with the housing 13 wherein the flange defines an outlet conduit therewithin. The web 11 itself includes a matrix of concave recesses formed coextensively throughout the length of the belt to better retain lotion therewithin for subsequent application to an individual. A rigid handle base 16 pivotally mounts the handle 12 thereon. The handle base 16 includes a continuous groove 17 formed throughout its forward surface to receive in a complementary manner the continuous flange 14 therewithin as illustrated in FIGS. 6, 7, and 11.

A cylindrical housing 13 in retractably mounting the elongate flexible web 11 therewithin includes a support cylinder 22 that fixedly mounts an end of the web 11 remote from the handle 12. A support spindle 18 is coaxially mounted through the support cylinder 22 with reduced threaded ends 19 projecting coaxially and exteriorly from each end of the support cylinder 22 with a lower threaded end 19 projecting through a lower ends surface of the housing 13 utilizing a securement fastener 20 to fixedly mount the lower threaded end of the support spindle with an upper threaded end of the support spindle mounted through an upper web of the housing **13*a* with a fluid impermeable socket 24 mounted overlying the threaded end to fluidly seal internal components of the support cylinder 22. An upper end of the housing 13 is coaxially aligned and parallel to the lower end of the housing mounting the lower end of the support spindle 18 and wherein the upper housing 13*a* is spaced below an externally threaded entrance conduit 30 mounting a cap 31 to permit introduction of a fluid lotion interiorly of the housing 30. Spaced retraction springs 21 are mounted within the support cylinder 22 wherein each spring 21 includes a first end fixedly mounted to a clip 22*a* (see FIG. 10) within the support cylinder 22 with the other end of the spring mounted within a spindle aperture 18*a* (see FIG. 6) to effect retraction of the support cylinder 22 subsequent to extension of the web 11 therefrom. Bearing rings 23 (see FIG. 5) are utilized to minimize binding of the support cylinder during its relative rotation within the housing 13**.

Figure 7:
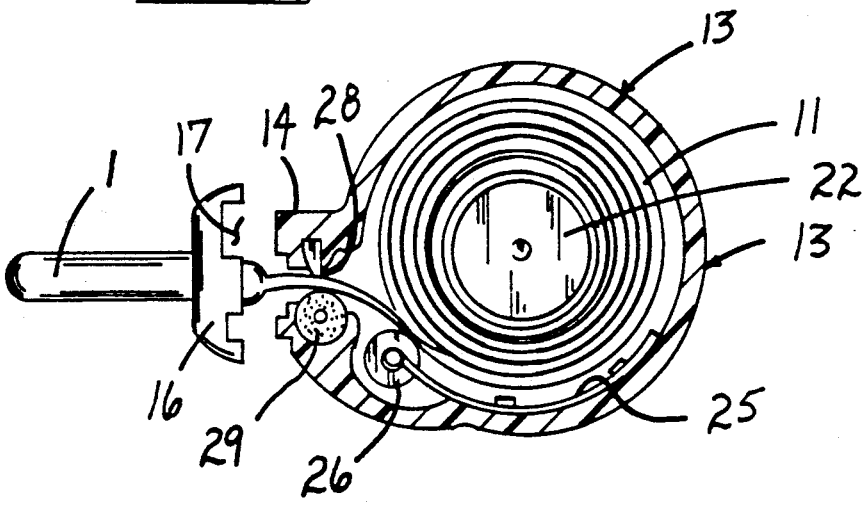
FIG. 7 is an orthographic top view taken in section of the instant invention in a retracted configuration.
Figure 8:
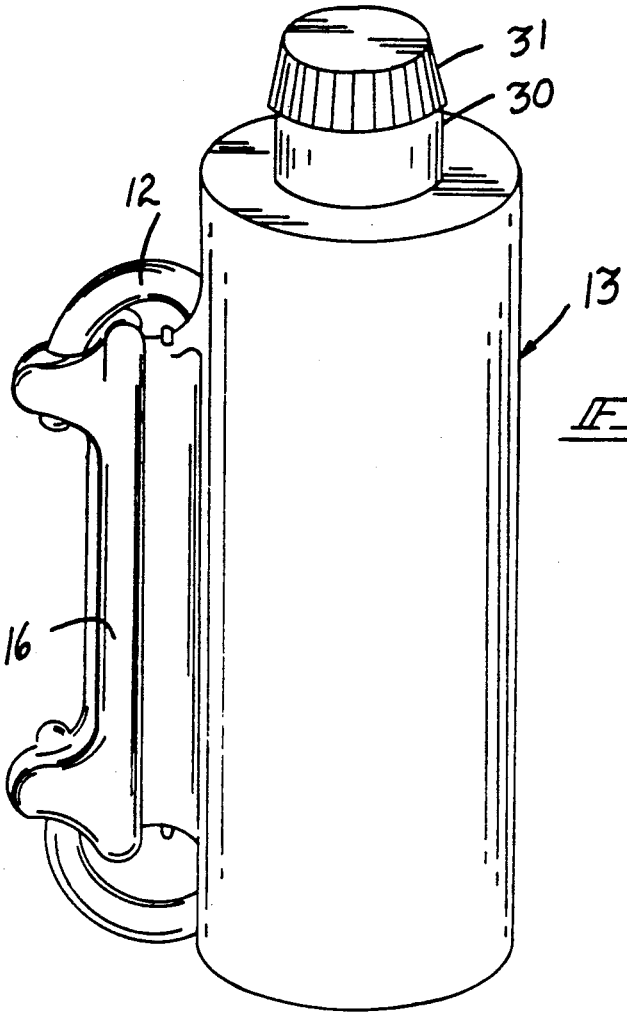
FIG. 8 is an isometric illustration of the invention illustrating the compact configuration thereof for storage.

Semi-annular springs 25 are mounted adjacent a first end against an interior wall of the housing 13 with their free ends terminating in a cylinder to accommodate cylinder fasteners 27 directed therethrough and into and coaxially of a friction cylinder 26 that is typically and normally biased to engage the web 11 and direct the web into a furled relationship relative to the support cylinder 22 as illustrated in FIG. 7. The web 11 is directed through the conduit defined by the continuous flange 14 and directed between an elongate resilient lip 28 that is conextensive with the conduit and an absorbent roller 29 rotatably mounted within the flange 14 and in a diametrically aligned relationship with the lip 28. The resilient engagement on opposite sides of the web 11 reduces and minimizes excess fluid from escaping from within the housing 13 during use of the organization. Further it should be noted that the handle 12 is pivotally mounted to the base 16 in a manner as illustrated in FIG. 8 wherein opposed ends of the handle 12 are pivotally mounted within upstanding ears of the base 16 to enhance a compact organization for transport and storage.

Figure 9:
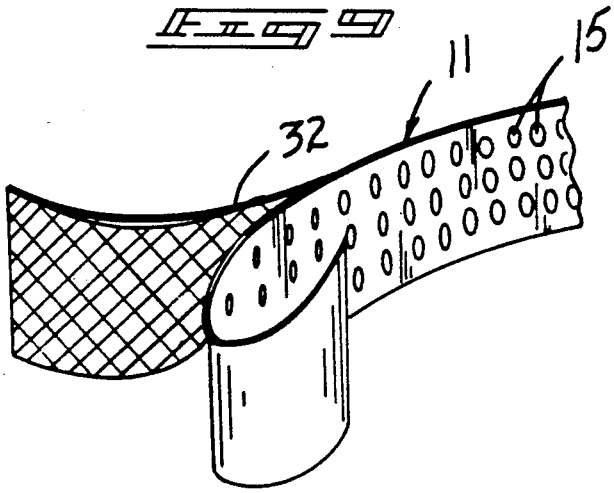
FIG. 9 is an isometric illustration of the flexible web utilized by the instant invention.
Figure 10:
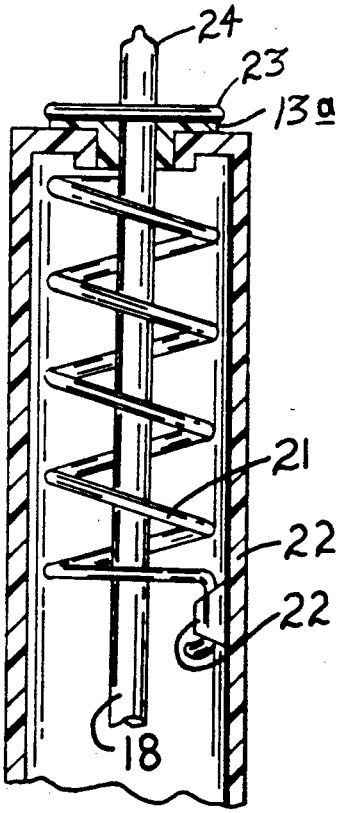
FIG. 10 is an orthographic cross-sectional side view of the support cylinder of the instant invention.
Figure 12:
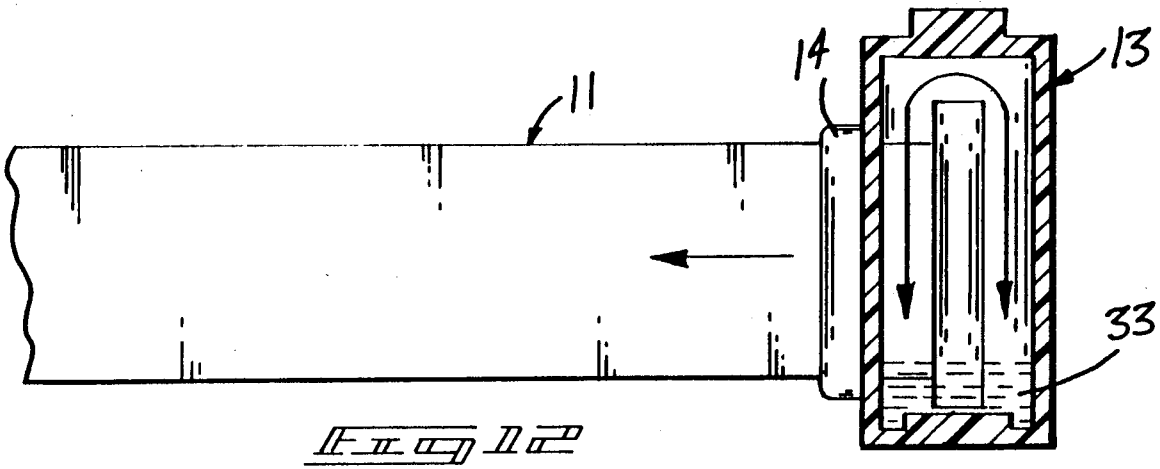
FIG. 12 is an orthographic cross-sectional illustration of the reservoir of the instant invention and the web in a extended configuration.
Figure 13:
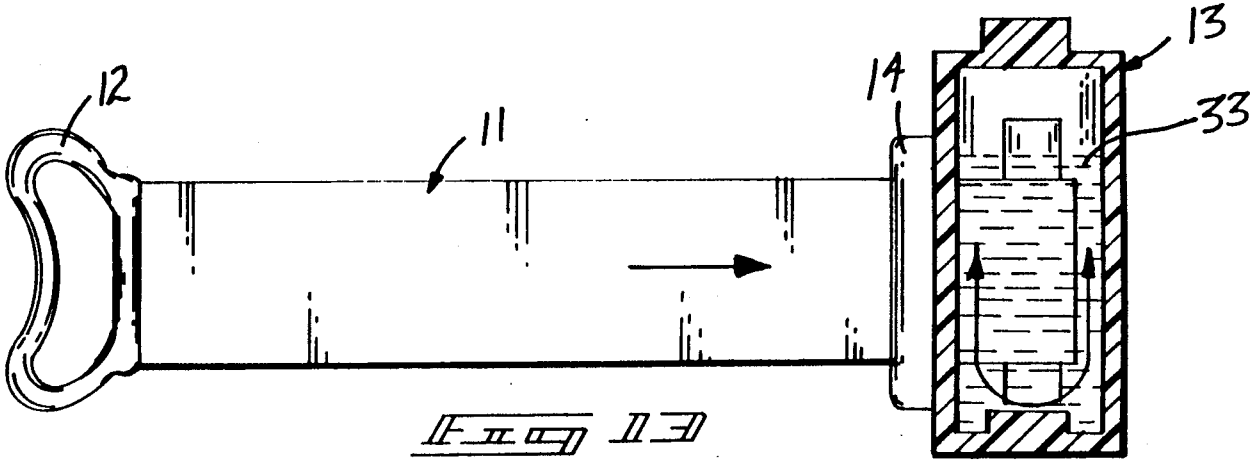
FIG. 13 is an orthographic cross-sectional view of the fluid reservoir of the instant invention and the web in a partially retracted configuration.

FIG. 9 illustrates the web 11 formed with a nylon mesh liner 32 to provide structural integrity to the web during its continuous use in an extension and contraction from the cylinder 13 to avoid stretching of the web and thereby maintain a fluid tight sealing between the lip 28 and the roller 29. Further the nylon mesh 32 is of a generally open weave to accommodate lotion therewithin in application and reception within the web 15 formed of a relatively absorbent material.

In use, (see FIGS. 11, 12, and 13) the handle 12 is grasped in one hand and the cylinder housing 13 in another subsequent to the cap 31 being removed and a predetermined quantity of fluid lotion 33 directed within the housing. The web is extracted and accordingly the fluid level 33 drops within the housing. The fluid level in return of the web 11 is replenished during its retraction minus whatever lotion is applied to an individual during use of the web 11 in application to an individual in a manner as illustrated in FIG. 3.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lotion applicator apparatus comprising in combination, an elongate axially aligned cylindrical housing, and an elongate flexible web normally biased and retracted within the housing in a first position and extensible relative to the housing in a second position, and retraction means mounted within the housing to secure a first end of the web and maintain the web within the housing in a furled orientation, and a second end of the web including a rigid base member, and a generally "U" shaped handle mounted pivotally to the base member, and wherein the housing includes an entrance nozzle including an externally threaded surface, and an internally threaded cap cooperative with the externally threaded surface to permit filling of the housing with a fluid lotion, and wherein the housing includes a continuous flange formed integrally to the housing and extending orthogonally therefrom defining a conduit within the flange, and the rigid base including a continuous groove, and the continuous groove accommodating the continuous flange therewithin in a complementary relationship, and wherein the retraction means includes a support cylinder mounting a first end of the web thereto wherein the support cylinder including a support spindle coaxially directed through the support cylinder wherein the support spindle includes spaced ends projecting from the support cylinder wherein the spaced ends include a lower end directed through a lower web of the housing coaxially aligned with the housing, and an upper end of the spaced ends directed through an upper web of the housing contained completely within the housing, and biasing means mounted between an interior wall of the support cylinder and mounted to the support spindle to normally bias the support cylinder to the first position, and wherein the biasing means includes a plurality of coaxially spaced springs wherein each spring includes a first end mounted to the interior surface of the support cylinder and a second end directed through and received within an aperture formed within the support spindle to secure each spring in a fixed relationship between the support cylinder and the support spindle, and wherein the web includes an open mesh belt contiguously and coextensively mounted to the web to maintain geometric integrity of the web in use, and the web including a matrix of concave recesses directed throughout its surface to enhance tension of fluid lotion within the web.

2. Apparatus as set forth in claim 1 wherein the rigid base includes a plurality of spaced ears, and the ears receiving spaced free ends of the U-shaped handle to pivotally mount the U-shaped handle relative to the base.

3. Apparatus as set forth in claim 2 further including a plurality of spaced semi-annular springs mounted interiorly of the housing wherein the springs are mounted in a spaced parallel relationship relative to one another fixedly secured to an interior surface of the housing and each semi-annular spring including a free end wherein the free end terminates in a conduit and the conduits are coaxially aligned relative to one another, and including a friction cylinder mounted between the conduits and friction cylinder fasteners directed through the conduits and into the friction cylinder to secure the friction cylinder relative to the semi-annular springs and normally bias the friction cylinder against the web and direct the web to the conduit defined by the continuous flange.

4. Apparatus as set forth in claim 3 further including an elongate resilient lip mounted within the flange and spaced in a parallel relationship relative to the support cylinder, and the lip arranged coextensively of the web as it is directed through the conduit.

5. Apparatus as set forth in claim 4 including an absorbent elongate cylidrical roller arranged in a spaced parallel relationship relative to the lip and rotatably mounted within the flange in a spaced relationship relative to the lip to effect a pinching of the web as it is directed between the lip and the cylindrical roller.

6. Apparatus as set forth in claim 5 wherein the lip, the cylindrical roller, the friction roller, the support cylinder, and the support spindle are arranged parallel relative to one another within the housing.

* * * * *